US005515090A

United States Patent [19]

Almgren et al.

[11] Patent Number: 5,515,090

[45] Date of Patent: May 7, 1996

[54] CAPILLARY UNIT FOR INK JET PRINTER

[75] Inventors: Bertil Almgren, Enskede; Terje Rye, Solna, both of Sweden

[73] Assignee: Siemens Elema AB, Solna, Sweden

[21] Appl. No.: 113,234

[22] Filed: Aug. 30, 1993

[30] Foreign Application Priority Data

Sep. 9, 1992 [SE] Sweden ..... 9202591

[51] Int. Cl.[6] ..... B41J 2/02

[52] U.S. Cl. ..... 347/75; 347/76

[58] Field of Search ..... 346/140 R; 347/75, 347/78, 74, 76, 77

[56] References Cited

U.S. PATENT DOCUMENTS 3,916,421 10/1975 Hertz ..... 346/75
4,274,100 6/1981 Pond ..... 346/75
4,306,243 12/1981 Taub et al. .
4,345,260 8/1982 Deproux .
4,417,255 11/1983 Furukawa .

OTHER PUBLICATIONS

Electrical/Electronic Power and Control, Product Engineering, Jul. 28, 1969, pp. 66–67.

*Primary Examiner*—Benjamin R. Fuller
*Assistant Examiner*—Craig A. Hallacher
*Attorney, Agent, or Firm*—Hill, Steadman & Simpson

[57] ABSTRACT

A capillary unit for an ink jet printer, having a nozzle for spraying a jet of ink onto a record carrier. The jet of ink breaks up into a series of droplets at a droplet formation point in front of the nozzle. A charging electrode, with which the ink droplets are selectively charged for subsequent electrical deflection, is arranged in the area of the droplet deflection point. The charging electrode is devised in the form of a plate, arranged perpendicular to the path of the jet, with a through hole for passage of the droplets. The charging electrode is further devised with at least one groove running from the hole to the outer edge of the electrode.

16 Claims, 2 Drawing Sheets

CAPILLARY UNIT FOR INK JET PRINTER

BACKGROUND OF THE INVENTION

This invention relates to a capillary unit for ink jet printers, having a nozzle for spraying a jet of ink onto a record carrier, the jet of ink breaking up into a series of droplets at a droplet formation point in front of the nozzle. A charging electrode, with which the ink droplets are selectively charged for subsequent electrical deflection, is provided in the vicinity of the droplet formation point.

Continuous pumping of ink through a fine nozzle in an ink jet printer of the above-described kind results in a continuous jet of ink which, at a given distance from the nozzle orifice, divides by spontaneous droplet formation into a string or series of droplets. Droplet formation is caused by instabilities in the ink jet as ink ejects from the nozzle's orifice. However, droplets created in spontaneous droplet formation vary in size, thereby reducing the quality of the printout obtained. Thus, attempts have been made to control droplet formation, so all droplets are of the same size in a uniform series, by mechanically vibrating the nozzle at a specific frequency.

For high-quality printout, the droplet formation point must also be set correctly in relation to the charging electrode, in addition to control of droplet formation. Proper setting of the droplet formation point in relation to the charging electrode is of the greatest importance to effective charging of the droplets and to enable correct control of droplets by the subsequent deflection electrode system.

In Electrical/Electronic Power and Control, Product Engineering, Jul. 28, 1969, pp. 66–67, an ink jet printer is described with charging electrodes in the form of two vertical, parallel plates arranged on either side of the droplet formation point. Varying the charging voltage applied to the charging electrodes charges the droplets to varying degrees, so they are deflected in the desired way in a subsequent, constant, vertical deflection field, wherein vertical movements are synchronized with horizontal movements achieved by mechanical movement of the nozzle and charging electrodes so the droplets strike the record carrier in a prescribed pattern.

The present invention refers to a type of printer with the record carrier arranged on a rotating drum, the droplet-emitting nozzle being moved perpendicular to the record carrier's direction of movement. A pulsed voltage for selective charging of the droplets to be deflected by subsequent deflection electrodes is applied to the charging electrode, so charged droplets do not reach the record carrier. For this type of printer, devising the charging electrode in the form of a plate with a through hole for passage of the droplets has proved to be advantageous.

However, one disadvantage with this type of charging electrode is that the droplet formation point cannot be visually observed. This makes the setting of the droplet formation point inside the electrode more difficult, and direct visual scrutiny of droplet formation is impossible.

SUMMARY OF THE INVENTION

An object of the present invention is to eliminate the disadvantages in the prior art design and achieve a capillary unit for an ink jet printer making possible direct visual inspection of the droplet formation point.

This object is achieved with a capillary unit which provides a nozzle for spraying a jet of ink onto a record carrier, arranged for the jet of ink to break up into a series of droplets at a droplet formation point in front of the nozzle. A charging electrode acts to selectively charge the ink droplets for subsequent electrical deflection, the electrode arranged in the vicinity of a droplet deflection point and devised as a plate arranged perpendicularly to the path of the jet. The plate has a through hole for passage of the droplets. The charging electrode has at least one groove extending from the hole to the electrode's outer edge. The electrode is attached to a nozzle holder which holds the nozzle.

Thus, a capillary unit according to the invention makes possible simple setting of the nozzle orifice with the droplet formation point in the correct position in relation to the charging electrode by means of direct visual inspection, so droplets achieve maximum charging in their passage through the electrode for effective, subsequent electrostatic deflection. Additionally, a stable and compact construction is obtained.

According to one advantageous embodiment of the capillary unit according to the invention, the nozzle consists of the orifice of a fine capillary tube through which the ink is pumped. The capillary tube and the charging electrode are suitably arranged in relation to one another on a common nozzle or capillary tube holder. A device is provided to mechanically vibrate the capillary tube at a given point along its length, imparting vibration to the ink so droplet formation is controlled and droplets of essentially the same size are ejected in a uniform series. The vibration device can advantageously consist of a piezoelectric crystal mounted on the capillary tube.

DETAILED DESCRIPTION OF THE PREFERRED EMBODIMENTS

Figure 1:
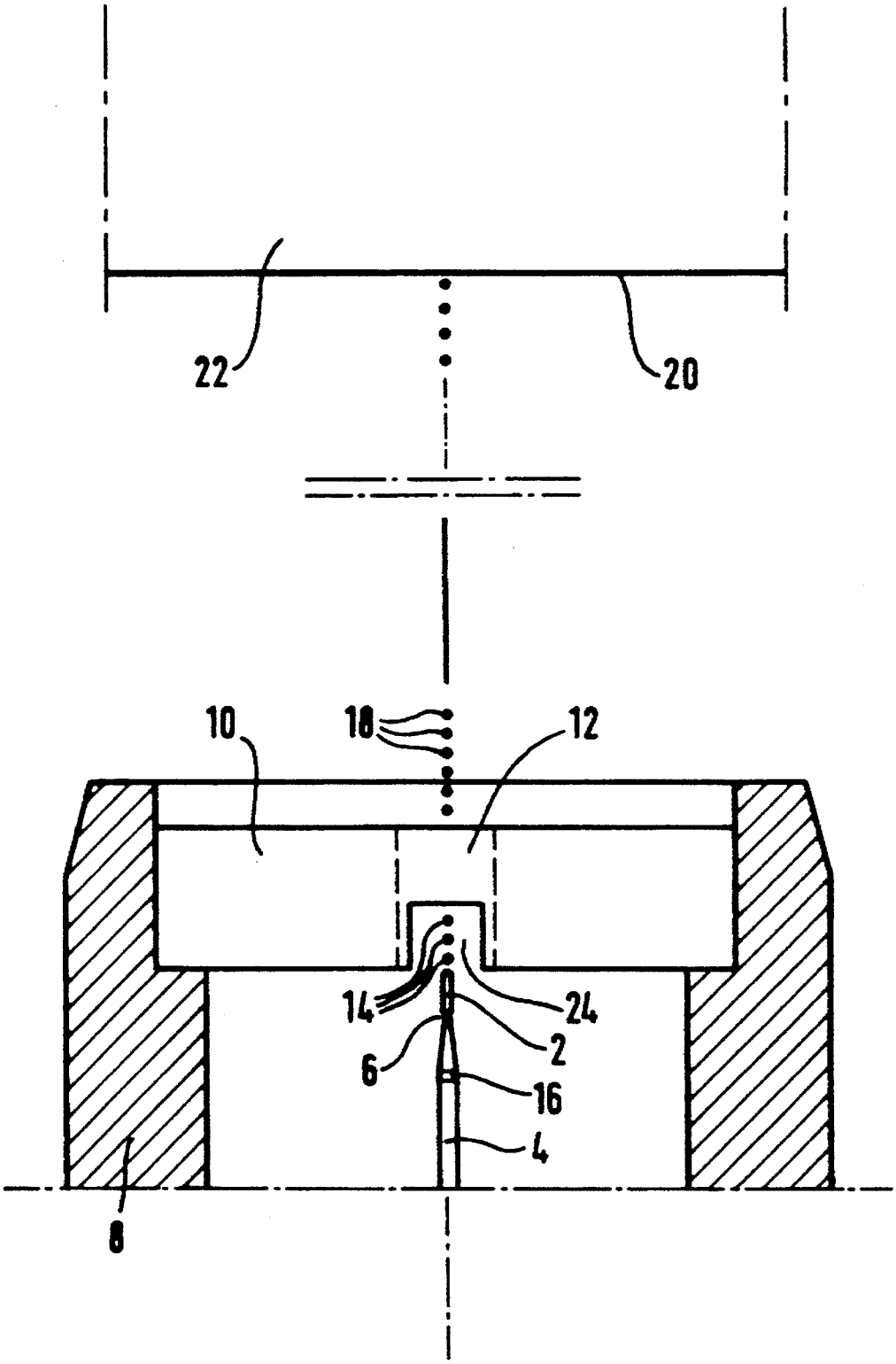
FIG. 1 is a longitudinal cross-section of the end of a capillary tube holder, holding a capillary tube and a charging electrode, and a record carrier on a drum in an ink jet printer according to the invention.
Figure 2:
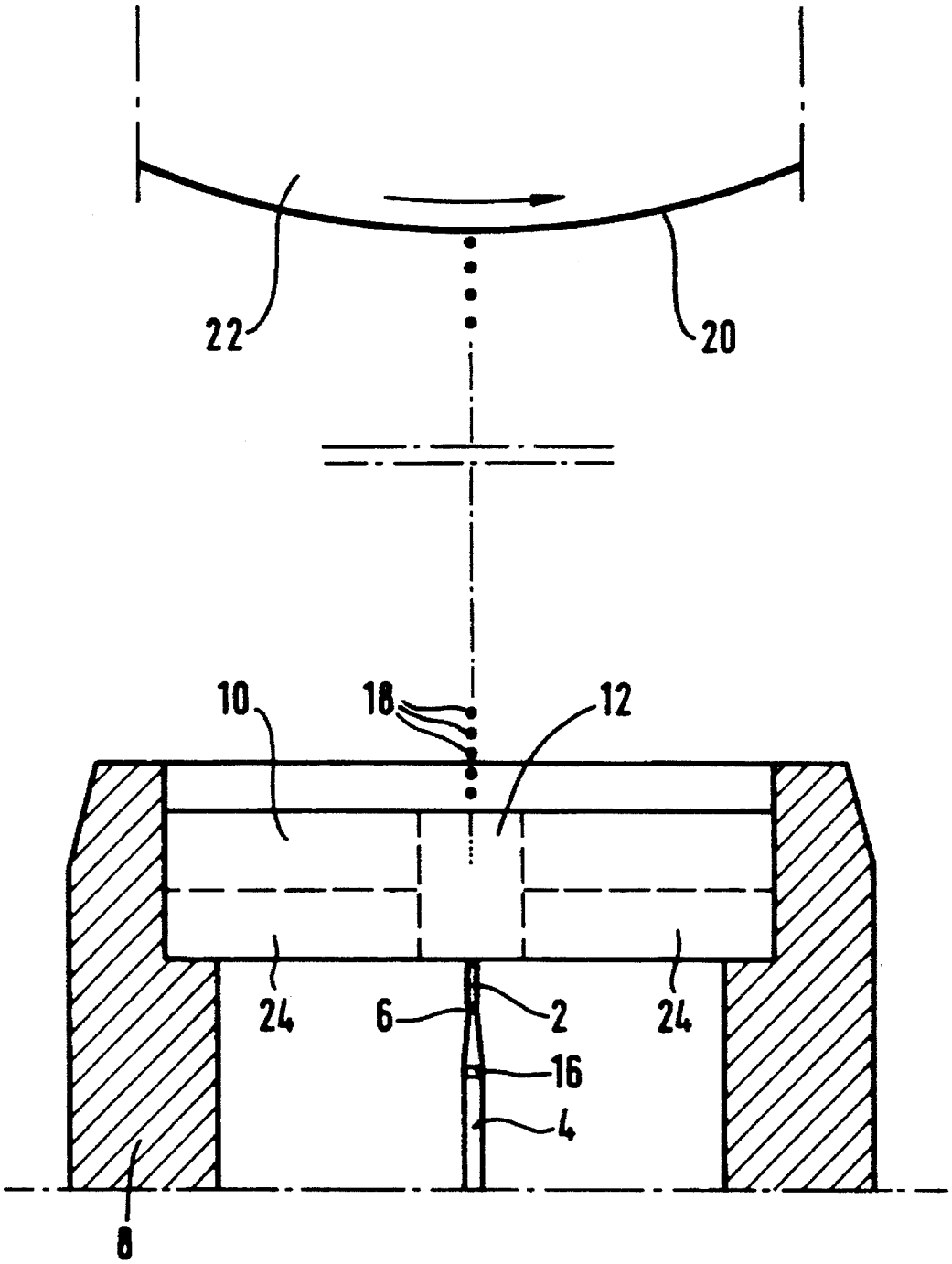
FIG. 2 is a corresponding longitudinal cross-section, rotated 90° in relation to the cross-section shown in FIG. 1.

In the version of the capillary unit according to the invention shown in the figures, a jet of ink 2 is ejected from a fine capillary tube 4 with a circular orifice 6.

The capillary tube 4 is carried, by a means not shown in detail, by a capillary tube holder 8, at whose anterior end is mounted, in a recess, a charging electrode in the form of a circular plate 10 with a through hole 12. The hole's center axis is arranged to essentially coincide with the longitudinal direction of the tube 4.

At a specific distance from the orifice 6 of the capillary tube 4, the jet 2 breaks up into a series or string of droplets 14. In the embodiment shown in the figures, the point at which the jet 2 breaks up into droplets 14, i.e., the droplet formation point, is inside the part of the charging electrode 10 nearest the orifice 6 of the capillary tube. The droplet formation point should suitably be at the edge of the electrode 10 nearest the orifice 6.

Droplet formation occurs spontaneously as a result of instabilities in the ink jet as ink ejects from the orifice 6. However, droplet formation can be controlled, so a series of uniformly sized droplets 14 forms when the capillary tube 4 is subjected to mechanical vibration. This can be suitably achieved when a piezoelectric crystal 16 is mounted at an appropriate location on the capillary tube 4 in order to impart vibration to the ink through the tube wall. The tube is heavily damped around the crystal 16 to keep the tube from vibrating as a whole.

The charging electrode is pulsed with a voltage from a voltage source (not shown) so droplets 14 are selectively charged by the electrode 10 in their passage through the electrode, and the charged droplets 18 can be deflected in the subsequent electrostatic deflection system (not shown), so they are collected by a sharp splitter bar and do not strike the record carrier 20. The droplets 18, which are intended to strike the record carrier 20, pass the charging electrode 10 without receiving any charge. Thus, they remain uncharged, are not affected by the electrostatic deflection system and strike the record carrier 20 in the prescribed pattern. The record carrier 20, usually paper, is mounted on a rotating drum 22.

For optimum printer operation, the charging electrode 10 must charge the droplets 14 to be removed as effectively as possible. For maximum charging of the droplets and, thus, the most sensitive printer possible, the position of the tip 6 of the capillary tube and the droplet formation point are of decisive importance. For this reason, at least one radial groove 24 is provided in the electrode plate 10 from the hole 12 out to the plate's 10 outer edge. The groove 24 makes possible visual observation of the droplet formation point inside the charging electrode 10 and facilitates adjustment of the position of the droplet formation point. The groove 24 also makes possible direct visual inspection of droplet formation.

Groove execution can be varied in a plurality of ways. For example, the depth of the groove can be varied, down to a value equal to the thickness of the electrode plate. The groove is formed by milling material out of the electrode plate.

Although the present invention has been described with reference to a specific embodiment, those of skill in the art will recognize that changes may be made thereto without departing from the scope and spirit of the invention as set forth in the appended claims.

We claim as our invention:

1. An ink jet printer for spraying a jet of ink onto a record carrier arranged on a rotatable drum, comprising:

a nozzle means adapted to receive a supply of ink for spraying a jet of said ink along a path onto said record carrier, said nozzle means being movable perpendicular to a direction of movement of said record carrier;

electrode means for imparting an electrical charge to said jet of ink including a plate disposed perpendicular to the path of the jet of ink having a through hole for passage of the jet of ink and an outer edge, and having at least one groove running from the hole to the outer edge, and a nozzle holder, said plate attached to said nozzle holder, said nozzle holder adjustably supporting the nozzle means, said groove arranged for visual observation of a droplet formation point of said jet of ink for position adjustment of said nozzle means with respect to said plate.

2. The ink jet printer according to claim 1, wherein the groove has a depth less than the thickness of the electrode plate.

3. The ink jet printer according to claim 1, wherein said plate is circular and said hole is disposed through a center of the plate, and said groove extends in an essentially radial direction.

4. The ink jet printer according to claim 1, wherein said electrode plate is circular and said hole is disposed through a center of said plate, and wherein said plate has two grooves respectively extending in essentially diametrically opposed radial directions.

5. The ink jet printer according to claim 1 comprising a capillary tube, wherein said nozzle means is formed by an orifice of said capillary tube.

6. The ink jet printer according to claim 5 comprising means for mechanically vibrating the capillary tube.

7. The ink jet printer according to claim 6, wherein said means for vibrating the capillary tube comprises a piezoelectric crystal mounted onto the capillary tube.

8. A capillary unit for an ink jet printer for spraying a jet of ink onto a record carrier arranged on a rotatable drum, comprising:

a nozzle means for spraying a jet of ink along a path onto a record carrier, said jet of ink separating into a series of droplets at a droplet formation point in front of said nozzle means, said nozzle means being movable perpendicular to a direction of movement of said record carrier;

a nozzle holder adjustably supporting said nozzle means; and electrode means for selectively charging said ink droplets for subsequent electrical deflection, said electrode means comprising a plate arranged perpendicular to the path of said ink droplets, with an outer edge and a through hole for passage of the ink droplets, said plate having at least one groove extending from the through hole to the outer edge, and said plate being attached to said nozzle holder, said groove arranged for visual observation of said droplet formation point for position adjustment of said nozzle means with respect to said plate.

9. The capillary unit according to claim 8, wherein said groove is formed in a direction perpendicular to the path of the jet and has a depth that is less than a thickness of the plate.

10. The capillary unit according to claim 9, wherein said plate is circular and said hole is disposed through a center of the plate, and said groove extends in an essentially radial direction.

11. The capillary unit according to claim 8, wherein said plate is circular with said hole disposed through a center of said plate and said plate having two grooves respectively extending in essentially diametrically opposed radial directions.

12. The capillary unit according to claim 11 comprising a capillary tube, wherein said nozzle means is formed by an orifice of said capillary tube.

13. The capillary unit according to claim 8 comprising a capillary tube, wherein said nozzle means is formed by an orifice of said capillary tube.

14. The capillary unit according to claim 13 comprising means for mechanically vibrating the capillary tube.

15. The capillary tube according to claim 14, wherein said means for vibrating the capillary tube comprises a piezoelectric crystal mounted onto the capillary tube.

16. The capillary unit according to claim 13, wherein said nozzle holder has an essentially cylindrical shape and said nozzle means is held coaxially therein and said plate has a circular shape with said hole arranged in a center thereof.

* * * * *